United States Patent [19]

Rice

[11] Patent Number: 5,038,746

[45] Date of Patent: Aug. 13, 1991

[54] PRECISION GRINDING WHEEL DRESSER WITH MOLDED BEARING AND METHOD OF MAKING SAME

[75] Inventor: Charles O. Rice, Springfield, Vt.

[73] Assignee: Vermont Rebuild, Inc., Springfield, Vt.

[21] Appl. No.: 507,043

[22] Filed: Apr. 9, 1990

[51] Int. Cl.[5] ..... B24B 53/00

[52] U.S. Cl. ..... 125/11.04; 125/11.14; 125/11.22; 125/11.18

[58] Field of Search ..... 125/11.04, 11.14, 11.18, 125/11.22; 384/215, 223, 317, 320, 321, 906, 907, 297

[56] References Cited

U.S. PATENT DOCUMENTS

| | | | |
|---|---|---|---|
| 2,529,026 | 11/1950 | Kestell | 125/11.14 X |
| 2,951,053 | 8/1960 | Rueter et al. | 384/907 X |
| 2,978,844 | 4/1961 | Umeda | 125/11.18 X |
| 3,464,845 | 9/1969 | Osborn et al. | 384/297 X |
| 4,046,432 | 9/1977 | Hofmann et al. | 384/906 X |
| 4,249,278 | 2/1981 | Pfaffle | 425/113 X |
| 4,287,957 | 9/1981 | Evans | 175/339 X |
| 4,340,262 | 7/1982 | Rugh et al. | 384/906 X |
| 4,582,368 | 4/1986 | Fujita et al. | 384/907 X |
| 4,805,585 | 2/1989 | Halvorsen | 125/11.14 X |
| 4,875,263 | 10/1989 | Furumura | 384/297 X |

*Primary Examiner*—D. S. Meislin
*Attorney, Agent, or Firm*—DeLio & Associates

[57] ABSTRACT

A grinding wheel radius dresser including a dresser housing, a spindle having a tapered outer bearing surface, a drive means for rotating the spindle and a damage resistant bearing. The bearing includes a tapered inner bearing surface produced by molding a low friction bearing material to match the tapered spindle bearing surface, and is mounted in the housing with the spindle bearing surface in rotating contact with the inner bearing surface. The bearing is preferably spring mounted to slide longitudinally into the housing in the event of an impact further minimize the likelihood of any damage.

The method of making the precision bearing and spindle assembly comprises the steps of machining a spindle, producing a precision tapered outer bearing surface on the spindle, positioning a mold cavity around the spindle bearing surface, providing a moldable bearing material and a hardener for the bearing material; cooling the bearing material and/or the hardener, reacting the moldable bearing material with the hardener, filling the mold cavity with the bearing material, and allowing the reacted bearing material to harden to form a bearing molded directly against the tapered spindle bearing surface.

19 Claims, 2 Drawing Sheets

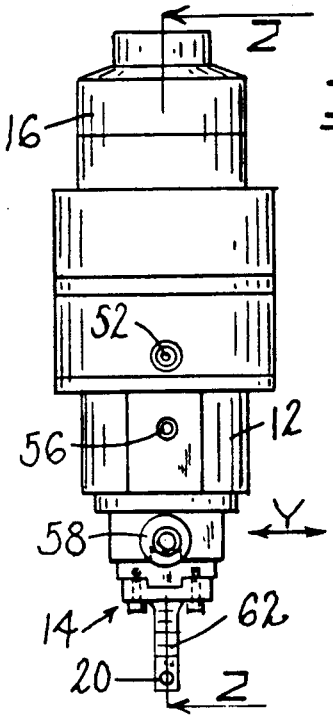
Fig. 1
Fig. 3
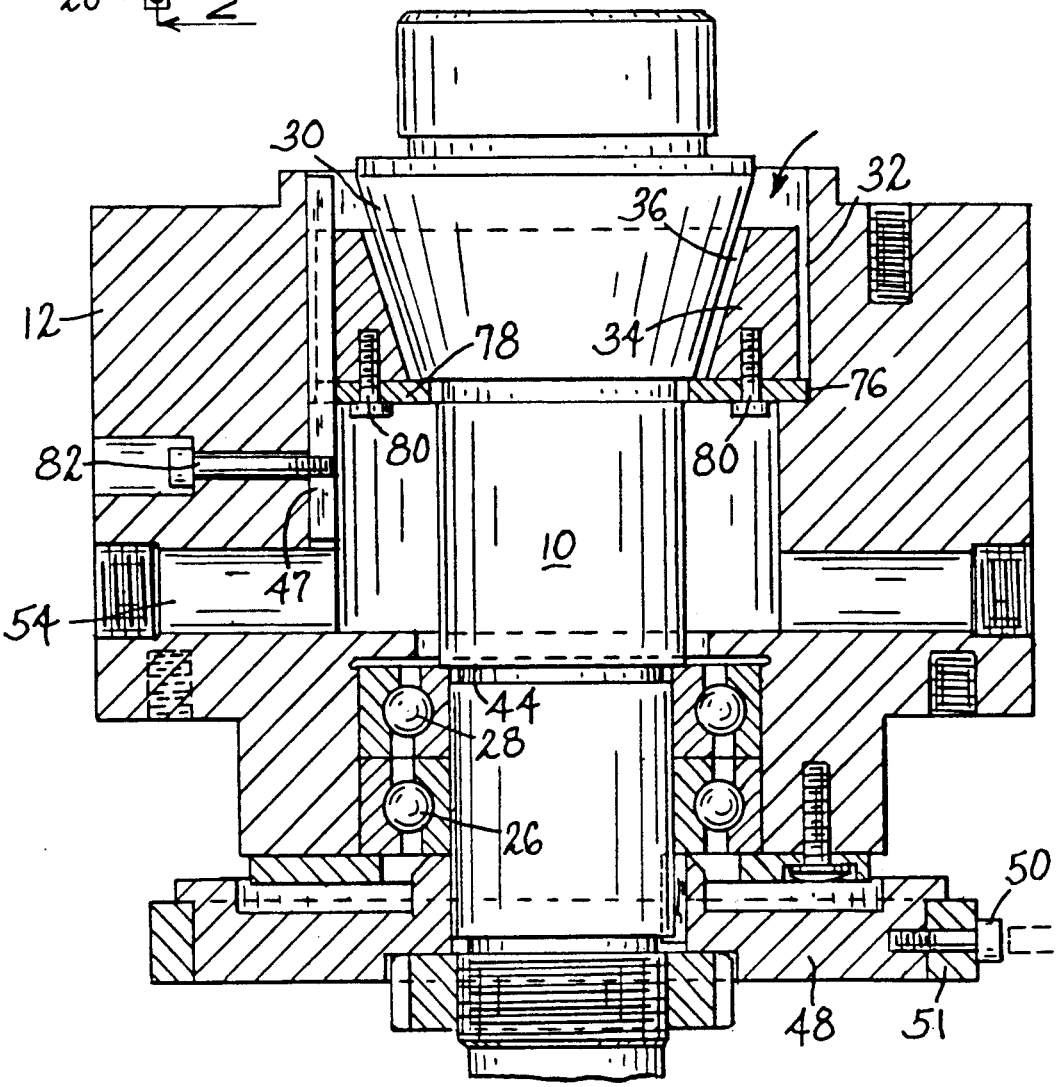

PRECISION GRINDING WHEEL DRESSER WITH MOLDED BEARING AND METHOD OF MAKING SAME

BACKGROUND OF THE INVENTION

I. Field of the Invention

This invention relates to radius dressers which are used to shape or "dress" precision grinding wheels of the type used in the manufacture of ball bearing assemblies and other precision parts. More particularly, this invention relates to the precision bearings required for such grinding wheel dressers, and specifically to molded bearings for use in such applications.

II. Description of Related Art

Modern grinding techniques are capable of grinding parts to tolerances of 20 millionths of an inch or better. However, to achieve this accuracy, the grinding wheel must be dressed to the same or better accuracy. Accordingly, when producing a curved surface on the final part, as is required on the races of ball bearings, the grinding wheel must be shaped by a radius dresser capable of moving the dressing tool along a curved path which is accurate to the desired tolerances.

Most modern radius dressers designed for such applications mount the dressing tool on a spindle held in ball bearings. As the spindle rotates, the dressing tool moves in a precision arc which forms the curved surface on the spinning grinding wheel. Any imperfection in the spindle bearings is directly transferred to the grinding wheel and from there to each ground part. As a result, although they are expensive, Class 7 angular-contact ball bearings are normally used to hold the spindle because they have the necessary precision for this application.

Unfortunately, ball bearings are subject to damage by impact which results in poor quality of the final part and expensive downtime as the bearings are replaced. This susceptibility to damage is the result of the design of ball bearings (and some other bearings) in which the high accuracy is achieved by limiting the contact area between the rotating components of the bearing to a relatively small high precision area along the races and the surface of the balls.

In ball bearings, the balls are essentially in point contact with the inner and outer races. All of the load carried by the bearing passes through these point contacts, which causes an extremely high load per unit area. Moreover, the load is usually carried by only one or two of the balls, and thus passes through very few point contact areas.

Consequently, if the grinding wheel dresser suffers an impact or "dresser wreck", the load at the point contacts of the ball bearing may exceed the load limit supportable by the bearing race material which permanently deforms the bearing race or the balls.

After such an impact the bearing race and/or the balls no longer have the required precision. As they rotate, they repeatedly contact the deformed area producing a corresponding motion by the dressing tool which is reproduced on the surface of the grinding wheel and ultimately on the surface of the part to be ground. This problem is most significant at the bearing closest to the dressing tool, as the bearing at this location suffers the highest loading and has the greatest effect on the precision of the dressing tool motion.

Nonetheless, in prior art designs, this disadvantage has been outweighed by the difficulty of producing a bearing having the necessary precision over a larger contact area that would spread the impact load and avoid deforming the bearing. Bearing designs other than ball bearings have been proposed, but they have still relied upon a small contact area between the rotating bearing parts to achieve the necessary precision. Simply stated, the smaller the bearing contact area, the easier it is to maintain the necessary accuracy, but the more susceptible to damage is the bearing.

Accordingly, a principal object of the present invention is to provide a bearing suitable for use in a precision radius dresser which is resistant to damage from impact.

SUMMARY OF THE INVENTION

The above objective is achieved through three principal features of the preferred embodiment of the invention. First, the bearing is molded such that the contact area between the bearing and a grinding wheel dresser rotor is many orders of magnitude greater than the contact area in a typical bearing. Second, the bearing material is slightly resilient and returns exactly to its original shape upon receiving a deforming impact. Thus, unlike a ball bearing, the deformation is only temporary. Third, the bearing is mounted with a spring loading technique which permits the bearing to move under impact instead of permanently deforming.

A grinding wheel dresser according to the invention includes a dresser housing, a spindle having a tapered outer bearing surface and a drive means for rotating the spindle. The spindle is mounted in at least one bearing having a tapered inner bearing surface produced by molding a low-friction bearing material to match the tapered spindle bearing surface. The bearing is mounted in the housing with the spindle bearing surface in rotating contact with the inner bearing surface.

In the preferred design, the bearing includes a bearing filler piece which reduces the effects of any shrinkage during the hardening of the bearing and which provides a force bearing surface for the most highly preferred design in which the bearing is spring mounted such that the spindle and bearing may slide into the housing responsive to a force applied parallel to the spindle.

The precision bearing and spindle assemble is preferably made by machining a spindle with a precise tapered outer bearing surface on one portion thereof. A mold cavity is provided around the spindle bearing surface. A moldable bearing material is then cooled and reacted with a hardener which releases heat during the reaction. The mold cavity is then filled with the bearing material and allowed to harden to form a bearing molded directly against the spindle bearing surface. The moldable bearing material is preferably cooled to a temperature below a selected bearing operating temperature by removing a quantity of heat approximately equal to the heat generated by reacting the hardener. This produces a molded bearing which hardens into the precise shape at approximately the bearing operating temperature.

The bearing material includes a lubricant, preferably a dry lubricant such as molydenum disulfide in an amount of up to 50% by weight. Amounts from 5% to 20% by weight are preferred, however.

BRIEF DESCRIPTION OF THE DRAWINGS

FIG. 1 is a front elevational view of the grinding wheel dresser.

FIG. 3 is a cross sectional view of the dresser housing and rotor in an inverted position ready for pouring the molded bearing.

DETAILED DESCRIPTION OF THE INVENTION

Figure 2:
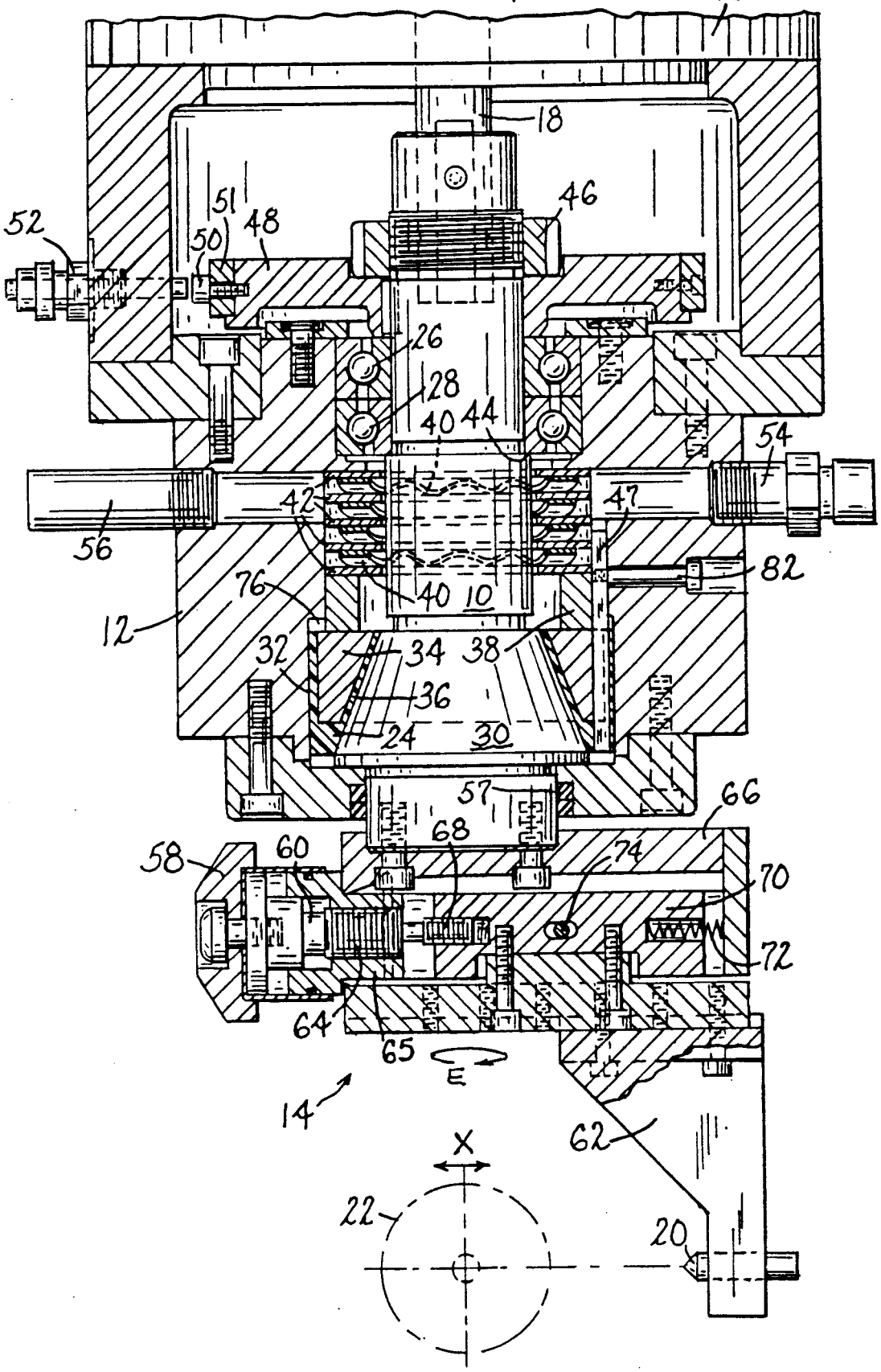
FIG. 2 is a partial cross sectional view along the line 2—2 of FIG. 1 showing the grinding wheel dresser and a grinding wheel. The dresser motor is only partially shown in this view.

Referring to FIGS. 1 and 2, the grinding wheel dresser of the present invention comprises a spindle 10 rotatably mounted inside a housing 12. An adjustable dressing tool holder, indicated generally by reference numeral 14, is mounted on the lower end of the spindle 10. Both the spindle 10 and the tool holder 14 are rotated by motor 16 mounted on the upper end of the housing 12 with the motor shaft 18 being connected to the upper end of the spindle 10.

The motor 16 is preferably numerically controlled and precisely positionable at any rotational angle to move the dressing tool 20 in a curved arc relative to the surface of the grinding wheel 22 to be dressed. Suitable radius dresser drive motors are well known to the art, and any of the prior art motors may be used provided that they have sufficient power and accuracy.

The preferred drive motor is a DC motor incorporating an ironless rotor design. An optical encoder and multiplier provide a feedback resolution of 36,000 increments per revolution.

The entire assembly shown in FIG. 1 will typically be mounted on a numerically controlled grinding machine. Upon command from the controller, the grinding wheel dresser and grinding wheel will be moved relative to one another such that the dressing tool 20 is brought into contact with the surface of the rotating grinding wheel 22 to begin the dressing operation.

In a common mounting configuration for a grinder with a workhead movable along the "Y" axis and a grinding head movable along the "X" axis, the dresser seen in FIG. 1 will be mounted on an extendable/retractable dresser mount (not shown) which slides or pivots to bring the dresser into and out of the dressing position. The dresser mount is usually attached directly to the workhead of the grinding machine.

In this configuration, and with the workpiece removed, the dresser may be moved along the Y axis (parallel to the plane of FIG. 1 and perpendicular to the plane of the drawing in FIG. 2) by moving the workhead to which it is attached. Because the grinding head and the grinding wheel 22 are movable in the X axis, i.e., to the left and right in the plane of FIG. 2, any point on the wheel 22 may be dressed. However, to achieve the highest accuracy for curved surfaces, spindle 10 rotates around the E axis. Precision simultaneous motion by the numerical control unit along one or more of the X, Y and E axes can produce any desired shape on grinding wheel 22.

Following the dressing operation, the dresser will be retracted, a new workpiece will be mounted, and the grinding wheel 22 will be moved into position to begin grinding.

Referring to FIG. 2, the spindle 10 is held within housing 12 at its lower end by bearing 24 and at its upper end by precision ball bearings 26, 28. These upper bearings are preferably Class 7 angular-contact precision bearings which are supplied in a matched set. A molded bearing similar to bearing 24 may also be used, if desired.

Bearing 24 is made of a molded low friction bearing material which is preferably poured in place between the tapered outer bearing surface 30 of the spindle 10 and the cylindrical mold cavity 32 formed within the housing 12. The method of making this bearing, which also forms part of the present invention, is described in greater detail below. For this description of the function and operation of the bearing 24, however, it is sufficient to note that the bearing is formed by pouring a flowable, low-shrinkage resin material mixed with a hardener and a lubricant, such as molybdenum disulfide, into the mold cavity and into intimate contact with the entire tapered outer bearing surface 30 of the spindle 10.

As the bearing material hardens, it forms a high precision bearing which exactly matches the accuracy of the spindle bearing surface 30. In the preferred design, the spindle bearing surface 30 is precision ground to an accuracy of 20 millionths of an inch or better.

Although the bearing 24 may be formed completely from the molded bearing material, it is preferred to mold a bearing filler piece 34 into the interior of the bearing. The bearing filler piece 34 has a generally cylindrical exterior and a tapered inner surface which approximately matches the slope of the spindle bearing surface 30 such that a relatively small diameter region 36 of bearing material is formed between the bearing filler 34 and the spindle bearing surface 30.

The outer surface of the bearing filler piece 34 is intentionally left with a rough machined surface to provide good adhesion between the bearing material and the filler piece.

A principal function of the filler piece 34 is to minimize the effect of any shrinkage of the bearing material as it hardens. Although the bearing material is selected for its dimensional stability during curing, some slight shrinkage is still possible. By reducing the amount of bearing material through the inclusion of a relatively thick filler piece, the effect of such shrinkage is reduced.

It will be noted that the bearing 34 is held inside the cylindrical bearing housing 32 which also serves as the mold cavity during manufacture. Accordingly, shrinkage in the bearing 24 during curing would cause the outer diameter of the bearing to decrease, resulting in an unacceptable looseness of the bearing 24 in its cylindrical cavity 32. The filler piece is effective in reducing any shrinkage along the diameter of the bearing to acceptable limits.

The thickness of the filler piece 34 is selected such that the thickness of the bearing material (as measured along a line perpendicular to the axis of the spindle and excluding the thickness of the filler piece) times the expected shrinkage of the bearing material is less than the tolerance required for the exterior dimension of the cylindrical bearing. Because the bearing 24 is designed to slide longitudinally in the cylindrical cavity 32, there must be some clearance between the outer diameter of the bearing 24 and the inner diameter of the mold cavity 32. Through an appropriate adjustment of the thickness of the bearing filler piece, the shrinkage of the selected bearing material, and the temperature at which the molding occurs, the bearing 24 may be produced with the desired clearance, without excessive looseness.

Shrinkage is not a problem on the inner surface of the bearing, as dimensional changes here are automatically compensated by the tapered relationship between the spindle and the bearing. The mold bearing cavity 32, however, cannot be tapered because the bearing 24 is designed to slide longitudinally into the housing as a further means of reducing impact damage.

The bearing filler piece 34 serves a second, force transfer function which aids this longitudinal sliding of the bearing, in addition to the filler function described above. The filler piece is coated on three sides by the bearing material, but on its upper surface it is even with the top of the bearing. This allows forces to be transferred from above, through a sleeve 38, down into the bearing filler piece 34 via the exposed upper surface, and then evenly throughout the bearing 24 without deforming the upper surface.

Sleeve 38, which is preferably formed of aluminum, is positioned between the filler piece 34 and a spring member comprising a stack of wavy washers 40 interleaved between flat washers 42. The wavy washers are formed of spring steel and are commercially available. They provide a spring force, when compressed, which is transferred through the sleeve 38 and onto the bearing 24. This spring force causes the bearing 24 to slide down the cylindrical bearing housing 32 holding the inner tapered surface of the bearing in intimate contact with the outer tapered bearing surface 30 of the spindle.

The spindle 10 is held in the housing, against this spring force, via the upper bearings 26, 28. These bearings are a matched set of high precision ball bearings whose outer races are fitted into the upper half of the housing 12. The upper bearings are mounted on the spindle 10 between the shoulder 44 (formed between the upper section of the spindle and the larger diameter central section) and the disk 48. Locking nut 46 tightly holds disk 48 against the bearings 26, 28. This also serves to provide the preload force required for the high accuracy, angular-contact matched bearings 26, 28 preferred for this application.

The arrangement described above permits the spindle 10 and tapered bearing surface 30 to move radially whenever a potentially damaging force is applied in this direction. As the radial force is applied, the angled interface between the outer tapered surface 30 on the spindle 10 and the inner tapered surface on the bearing 24 causes the bearing to slide longitudinally into the housing. This allows the lower end of the spindle to move radially, thus reducing the likelihood of any damage. After the force is removed, the bearing 24 slides back into position under the influence of the spring force from the stack of compressed wavy washers 40 thereby bringing the spindle back into alignment.

The housing 12 includes a removable key 47 which engages a keyway formed as the bearing 24 is cast. The key 47 prevents the bearing 24 from rotating inside the housing while permitting it to slide up inside the cylindrical bearing housing 32 as previously described.

Disk 48 is keyed to rotate with the spindle 10 and includes a small stud 50 mounted on a homing ring 51 at the perimeter of disk 48 which activates proximity switch 52 to signal the numerical control unit (not shown) that the dresser tool has been brought into the home position. The homing ring 51 may be rotated to any desired position around the perimeter of disk 48 and locked in position to set a predetermined starting location.

During operation of the dresser, the rotation of the spindle generates friction due to the large contact area between the bearing 24 and spindle bearing surface 30. This friction is reduced through the use of a lubricant, preferably a dry lubricant such as molybdenum disulfide or graphite, which is mixed with the bearing material during the molding operation.

Nonetheless, this friction may be sufficient to generate a significant amount of heat, resulting in a differential expansion between the housing 12 and the bearing 24 due to the difference in the thermal expansion coefficient of the respective materials. Any differential expansion between the spindle 10 and the bearing 24 is compensated by the tapered shape of the bearing surface 30. However, if the housing is heated excessively, the diameter of the cylindrical bearing housing 32 will exceed the diameter of the bearing 24, resulting in a looseness of the bearing which directly affects the accuracy of the dresser.

To prevent this, and to accommodate different ambient temperatures, the housing 12 is provided with a cooling system. The preferred cooling system is a vortex tube cooler which operates at sonic or near-sonic velocities to split compressed air, such as is available in most industrial manufacturing facilities, into a warm air stream and a cold air stream. The cold air stream is directed into the housing through air inlet 54. The air then passes across the spindle and through the spring washers and out a muffler/restrictor 56.

Vortex tube coolers are widely available. Although any type of cooling system may be adopted, including electronic refrigeration, other forms of air expansion cooling, or conventional freon/compressor systems, air cooling is preferred so that the housing may be pressurized. The vortex tube (not shown) is mounted at any convenient location near the dresser and the cold air is brought into the housing via a pipe attached to inlet 54. The cooling of the system is controlled by restricting the cold air flow at the outlet 56. The restrictor at 56 also acts as a muffler to reduce airflow noise in the vicinity of the operator.

A thermostatically controlled flow unit may also be used to control the temperature, but in most applications, this has not been found to be necessary, and the restrictor is adjusted manually.

The cold air which enters the housing 12 through inlet 54 maintains the housing at a slight positive pressure which helps prevent contamination of the dresser housing by grinding debris. The housing is further sealed against the entrance of contaminates by gasket 57 which seals between the housing and the spindle.

The tool holder 14 is designed for adjustment at a rate of 6 thousandths of an inch (0.006 inches, 0.15 millimeters) per revolution of the knurled knob 58 which drives a differentially threaded shaft 60. The desired precision adjustment is achieved through the differential between a first portion 64 of the shaft 60 which is threaded at 24 threads per inch (0.94 threads per millimeter) and a second portion 68 of the same shaft 60 threaded at 28 threads per inch (1.1 threads per millimeter).

The first portion 64 of the threaded shaft 60 is threaded into a piece 65 which is fixed relative to the dressing tool base 66. The dressing tool base 66 is bolted to the spindle 10. Thus, as the knurled knob 58 is rotated counterclockwise, the threaded shaft 60 moves out of the base 66 (to the left in FIG. 2) at the rate of 1/24 of an inch (0.042 inches, 1.06 mm) per revolution. At the same time, slide member 70, which is threaded onto the second portion 68, is pushed into the base 66 (to the right in FIG. 2) at the slower rate of 1/28 of an inch (0.036 inches, 0.91 millimeters) per revolution.

The differential between the outward motion of the threaded shaft 60 and the slower reverse motion of the slide member 70 causes the tool head 62 and the dressing tool 20 (which are carried by the slide member 70) to move towards the grinding wheel 22 (to the left in FIG. 2) at the rate of 6 thousandths of an inch (0.15 mm) per revolution. Coarse adjustments in the position of the dressing tool 20 are made by unbolting the tool head 62 and moving it relative to the slide member 70.

A spring 72 is provided at the base of the slide member 70 to remove backlash from the two threaded portions 64, 68. When the dressing tool 20 has been moved to the correct position by the differential thread adjustment mechanism, the adjustable head is locked in position by tightening bolt 74 which clamps the complete assembly.

The dresser tool typically includes a diamond dressing tip. The position of the dressing tool may be roughly set in a conventional manner by mounting a micrometer setting gauge on the tool holder. Final adjustments are made with knurled knob 58.

METHOD OF MAKING THE BEARING

To achieve the desired precision for the bearing 24, it is preferred to cast it in place, inside the housing 12, in direct contact with the bearing surface 30 on the spindle and the cylindrical bearing housing 32.

The first step in production is to assemble the spindle inside the housing 12 with the cylindrical bearing housing 32 facing upwards as is shown in FIG. 3. The spindle is assembled without the wavy washers 40, flat washers 42 or the sleeve 38. The bearing filler piece is held in position via a mold plate 78, which is removed and discarded after the bearing is formed. The mold plate is located in the small gap marked with reference numeral 76 in FIG. 2. The mold plate 78 is sealed with a silicone sealant against the housing 12 and the rotor 10 to prevent the escape of the bearing material during the molding process.

The preferred bearing material is capable of flowing into the smallest of crevices to perfectly conform to the shape of the mold, and, accordingly, failure to seal the mold properly may result in contamination of the bearings 26, 28.

As a further preventative, the bearings 26, 28 are filled with grease. They have previously been test-positioned at several locations relative to one another to determine their optimum position, and this position has been marked on the bearings.

With the mold sealed and the mold plate and bearing filler piece in position around the spindle, the bearing material is prepared by mixing it with a lubricant such as molybdenum disulfide, graphite, silicone or similar material. The preferred lubricant is a dry lubricant such as molybdenum disulfide.

The bearing material should be wear-resistant and have a high compressive strength with low shrinkage. It should be oil and coolant resistant and be compatible with the selected lubricant filler.

The preferred bearing material is a castable proprietary epoxy resin sold under the trade name "Moglice" by Diamant Metallplastic GmbH. To improve the lubrication properties, up to 50% by weight of a lubricant such as molybdenum disulfide may be added to the organic resin selected. The preferred range is 5 to 20% by weight. The Moglice material is manufactured with approximately 10 mg per cubic meter of molybdenum disulfide, and an additional 10% by weight has been found to be effective for the desired improved lubrication.

The selected resin is hardened with an appropriate hardener, which generates heat during the hardening reaction. The released heat of reaction may affect the dimensional accuracy of the resulting bearing. Consequently, the preferred method of making the bearing includes cooling the hardener and/or the bearing material below the desired bearing operating temperature by removing a quantity of heat approximately equal to the heat generated in the reaction. This ensures that the bearing will harden at approximately the temperature it will be operated at, which is usually room temperature. Cooling to 35°–45° F. (2°–7° C.) is usually sufficient.

Screws 80 hold the filler piece to the mold plate 78 and thus hold the filler piece 34 in concentric position around the spindle 10. Key 47 is held in position in the housing 12 by bolt 82.

The chilled mold material is poured into the mold cavity formed within the housing 12 at a point 180° opposite from the key. This helps avoid the formation of bubbles in the vicinity of the keyway formed by key 47 so that the bearing can slide longitudinally along the key without difficulty.

After hardening, the bearing is allowed to cure for at least 24 hours. Forty-eight hours is preferred before it is removed from the housing by loosening screw 82 and removing nut 46. The mold plate 78 is then removed and discarded, as are bolts 80. The key is removed from the bearing and replaced in the housing, leaving the keyway formed in the bearing. The cast bearing 24 is then lightly machined on the non-bearing surfaces for cosmetic reasons, the corners are deburred, and the excess mold material as well as the grease in bearings 26, 28 is removed. After an additional 24 hours, the outside diameter is checked for proper clearance with the inside of the cylinder 32 within which it slides. The dresser is then assembled with sleeve 38, and the wavy washer stack 40, 42, as shown in FIG. 2, and the bearings 26, 28 are replaced in their previously marked preferred orientation.

While the invention has been illustrated and described in what are considered to be the most practical and preferred embodiments, it will be recognized that many variations are possible and come within the scope thereof, the appended claims therefore being entitled to a full range of equivalents.

I claim:

1. An impact resistant grinding wheel dresser comprising:

a dresser housing;

a spindle having a tapered outer bearing surface;

a precision bearing having a tapered inner bearing surface comprising a low friction resilient bearing material molded to match the tapered spindle bearing surface, the bearing being slidably mounted in the housing, relative to the spindle and the housing with the spindle bearing surface in rotating contact with the inner bearing surface; and a drive means for rotating the spindle.

2. A grinding wheel dresser according to claim 1 wherein the bearing includes a bearing filler piece molded into the interior of the bearing having a diameter larger than the spindle bearing surface such that the molded bearing material forms the inner bearing surface between the bearing filler piece and the spindle bearing surface.

3. A grinding wheel dresser according to claim 2 wherein the thickness of the bearing filler piece in the vicinity of the inner bearing surface is greater than the thickness of the bearing material between the bearing filler piece and the spindle bearing surface.

4. A grinding wheel dresser according to claim 1 wherein the drive means is controllable via a numerical controller to rotate the spindle and position the tool holder.

5. A grinding wheel dresser according to claim 1 further comprising a spring member mounted between the housing and the bearing.

6. A grinding wheel dresser according to claim 5 wherein the spring member comprises at least one wavy washer.

7. A grinding wheel dresser according to claim 1 wherein the bearing is directly molded against the tapered outer bearing surface of the spindle to form a matched bearing and spindle set.

8. A grinding wheel dresser according to claim 7 wherein the bearing is longitudinally slidable in the housing and is formed by directly molding the bearing inside a smooth cylindrical bore in the housing, the bearing being longitudinally slidable inside the bore.

9. A grinding wheel dresser according to claim 7 further including a key mounted within the housing, the bearing being directly molded against the key to form a longitudinal keyway in the bearing.

10. A grinding wheel dresser according to claim 1 wherein the bearing is formed of a hardened organic resin.

11. A grinding wheel dresser according to claim 1 wherein the bearing material contains a lubricant.

12. A grinding wheel dresser according to claim 11 wherein the lubricant is molybdenum disulfide.

13. A grinding wheel dresser according to claim 12 wherein the bearing material includes 50% or less by weight of molybdenum disulfide.

14. A grinding wheel dresser according to claim 12 wherein the bearing material includes between 5% and 20% by weight of molybdenum disulfide.

15. A grinding wheel dresser according to claim 1 further including a bearing cooling means.

16. A grinding wheel dresser according to claim 15 wherein the bearing cooling means comprises a cold air flow cooling system, the air flow being directed through the housing.

17. A grinding wheel dresser according to claim 16 wherein the air cooling system includes a combined muffler and restrictor to control the rate of air flow.

18. A grinding wheel dresser according to claim 16 wherein the bearing cooling system comprises a vortex tube.

19. An impact resistant grinding wheel dresser comprising:

a dresser housing having a bearing opening with a smooth inner wall;

a spindle mounted in the housing, the spindle having a drive end and a tapered outer bearing surface, the taper decreasing in diameter towards the driven end;

a precision bearing slidably mounted in the bearing opening relative to the spindle and the housing, the bearing having a tapered inner bearing surface in direct rotating contact with the spindle bearing surface and a smooth outer surface in longitudinal sliding contact with the inner wall of the opening, said bearing being formed of a resilient impact resistant bearing material;

a spring member mounted between the housing and the bearing, urging the bearing into contact with the spindle; and a drive means for rotating the spindle connected to the drive end of the spindle.

* * * * *